United States Patent [19]

Katafuchi et al.

[11] Patent Number: 4,966,355

[45] Date of Patent: Oct. 30, 1990

[54] COPYING PAPER FEEDING DEVICE FOR AN ALIGNMENT TRAY OF A COPY MACHINE

[75] Inventors: Toshinobu Katafuchi, Hyogo; Hiroyuki Hamakawa, Nara, all of Japan

[73] Assignee: Mita Industrial Co., Ltd., Osaka, Japan

[21] Appl. No.: 225,007

[22] Filed: Jul. 27, 1988

[30] Foreign Application Priority Data

Jul. 31, 1987 [JP] Japan ..... 62-193117
Aug. 31, 1987 [JP] Japan ..... 62-218295

[51] Int. Cl.[5] ..... B65H 5/22

[52] U.S. Cl. ..... 271/3.1; 271/4; 271/110; 271/114; 271/227; 271/245; 271/246; 271/265; 271/163

[58] Field of Search ..... 271/3.1, 4, 110, 111, 271/114, 117, 227, 245, 246, 202, 265, 270, 65, 163

[56] References Cited

U.S. PATENT DOCUMENTS 4,697,911 10/1987 Kojita et al. ..... 271/3.1 X

FOREIGN PATENT DOCUMENTS 0078930 5/1983 Japan ..... 271/110
0002641 1/1986 Japan ..... 271/114
0201736 9/1987 Japan ..... 271/110
0602448 4/1978 U.S.S.R. ..... 271/114

*Primary Examiner*—David H. Bollinger
*Attorney, Agent, or Firm*—Koda & Androlia

[57] ABSTRACT

A copying paper feeding device for an intermediate tray for use in a copying machine having functions of creating a copy on both sides of a paper or printing a compound copy. In the device while being pressed by a push-out roller, copying papers fed into the intermediate tray are delivered by the rotation of the push-out roller in the direction of a copying paper aligner located downstream and upper-positioned copying papers are pushed out a little further than lower-positioned copying papers in response to a counted number of copying papers fed into the intermediate tray.

3 Claims, 5 Drawing Sheets

COPYING PAPER FEEDING DEVICE FOR AN ALIGNMENT TRAY OF A COPY MACHINE

BACKGROUND OF THE INVENTION

1. Field of the Invention

The present invention relates to a copying paper feeding device of an intermediate tray for use in a copying machine with functions of both-side copy, composite copy, etc. and which unit, in particular, contributes to a solution of failure in paper feed.

2. Description of the Prior Art

FIG. 2 is a schematic cross sectional side view showing an example of a photocopying machine wherein the both-side copying can be achieved.as described above, and FIG. 3 is a view showing in detail part of a copying paper feeding device in an intermediate tray in the copying machine.

As illustrated by these drawings, paper supply cassettes 4, 5, 6 are received by the machine body 3. For example, when a paper to be copied, which has been transported from said paper supply cassette 6 by means of a supply roller 7, passes near a photosensitive drum 9 through a transport device 8, a toner image formed on the surface of said photosensitive drum 9 is transferred to the paper.

Then, the paper is fed by a conveyor belt 10 to a fixing roller 11. The paper on which the toner image has been fixed by the fixing roller 11 is discharged by a discharge roller 12 to a discharge tray not shown, when the paper is not subjected to processing for double-side copying.

If the double-side copying operation is conducted, after passed through said fixing roller 11, the paper reaches a switch-back member 13, where the paper is turned to run through separating trays 14*a*, 14*b* down to an intermediate tray 15.

A push-out roller 20 is provided downstream of the intermediate tray 15 relative to the direction in which the paper is fed and at the leading end of a lever (not shown) which is tossable around a shaft 16 as shown in FIG. 3. This push-out roller 20 is pressed by its own weight against a friction plate 21 mounted on the bottom of said intermediate tray 15.

There is provided as pointed by an arrow 22 a stopper 23 bendably on the place downstream of the intermediate tray 15. A friction plate 26 is mounted on a curved passage 25 for paper which starts from said stopper 23 via a feed roller 24 to said transport device 8. A roller 27 in slidable contact with the friction plate 26 and said push out roller 20 are connected with each other by a belt 28 in such a manner that the both rollers may rotate together.

Said push-out roller 20 is separated from the intermediate tray 15 by a pin 29 mounted on said lever not shown which is pushed upward by a solenoid 30 each time the paper is discharged one by one by the push-out roller 20.

In the vicinity of said push-out roller 20 are provided a slit plate 31 and a photointerrupter PI. The slit plate 31 is put in contact with the surface of the copying paper delivered out by the roller 20 and driven by the paper into rotary motion. The photointerrupter PI is intended to measure the delivery rate of paper being copied, by counting the number of a pulse of a light beam running through said slit plate 31.

In this connection, after being fed into the intermediate tray 15 via the separating trays 14*a*, 14*b*, the paper is pushed forward by the push-out roller 20 in action with the leading end of the paper inserted the nip portion of between said friction plate 21 and the roller 20. The control of the delivery rate of the paper to be fed is performed by counting the number of rotations of the slit plate 31 in response to a signal from said photointerrupter PI. However, with the slit plate 31 having adjacent slits not closely spaced, the arrangement is such that by rotating the pushout roller 20 for a certain period of time only after a determined number of pulses from the photointerrupter PI has been inputted, the paper is pushed forward for a predetermined length.

The paper thus delivered is abutted by its leading end on the stopper 23 and the paper will be maintained more or less flexed between the roller 20 and the stopper 23. At the point of time, the push-out roller 20 stops its rotation, which the operation of the solenoid 30 follows to lift the push-out roller 20. This releases the paper from its flexed position with its leading end in contact with the stopper 23. Subsequently, the solenoid 30 is actuated again, and the push-out roller 20 will next on the paper so that the latter will be interposed between the push-out roller 20 and the friction plate 21 against the following supply of a paper being copied.

When a set number of sheet of papers are supplied to the intermediate tray 15, the stopper 23 is swung in a retractive direction or in a direction in which it will fall down. And then the push-out roller 20 is rotated to send out to the feed roller 27 a sheet of paper located on the top of a stack of the papers.

The supply roller 27 delivers to the feed roller 24 along the passage 25 the paper which has been transported under the control of the friction plate 26 preventing the paper from accompanying other papers. The feed roller 24 further sends out the paper to the transport device 8. After passing through the feed roller 24, the paper runs through the photosensitive drum 9 to undergo the copying process on its reverse side, then travelling with the conveyer belt 10 via fixing roller 11, and discharge roller 12 before it is discharged from the machine.

Said push-out roller 20 is adapted to send out the paper once processed for copying as it is in contact with the surface of the paper, and therefore, the paper must not be pressed so hard by the push-out roller 20 lest the surface of the paper should become stained. For this purpose, said push-out roller 20 is so designed that while supported by the tossable lever, it will be moderately pressed on the surface of the paper by its own weight. However, if a large number of papers are supplied, said lever on which the pushout roller 20 is mounted will be inclined to a greater extent that the pressure force applied to the copying paper will be diminished. This makes it impossible to obtain a necessary and sufficient delivery rate of paper. Such a trend would be more remarkable with the papers forming top layers of the stack of papers introduced into the intermediate tray 15. Above all, some paper has a low coefficient of friction in its nature; such a paper can not be pushed out sufficiently, and so when it gets in contact with the stopper 23, a proper amount of flex is hardly obtainable. For this reason, there may occur a lack in delivery rate in case of a paper having a especially low coefficient of friction.

When additional papers are brought in, some of the papers located in the comparatively lower section of a stack of papers on the intermediate tray 15 may be advanced to a certain degree accordingly, whereby the above-described shortage of delivery rate made by the push-out roller 20, if any, would never create a big problem. Contrary to this, since none of the papers on the uppermost layer will ever been moved out accompanied by the papers forming the upper layers, the delivery shortage is most likely to be particularly considerable.

SUMMARY OF THE INVENTION

In view of the foregoing circumstances has been made this invention.

In accordance with the first aspect of this invention there is provided in a copying paper feeding device of an intermediate tray in which a copying paper with one side formed with a toner image, which is stored temporarily within the intermediate tray, is transported by the rotary motion of a push-out roller, while being under pressure of the latter, toward a copying paper alignment means downstream of the roller, an arrangement such that the number of sheets of the papers introduced into the intermediate tray is counted, the delivery rate of papers to be pushed out by the push-out roller is changed in response to the count value, so that the upper-positioned papers will be pushed out a little farther than the lower-positioned papers.

According to the second aspect of the present invention, there is provided in a copying paper feeding device of an intermediate tray in which a copying paper with one side formed with a toner image, which is stored temporarily within the intermediate tray, is transported by the rotary motion of a push-out roller, while being under pressure of the latter, toward a copying paper alignment means downstream of the roller, an arrangement such that the number of sheets of the papers introduced into the intermediate tray is counted, and that when the last copying paper corresponding to the set number of papers is advanced by the push-out roller, the paper will be pushed out a little farther than the other papers.

In said copying paper supply device, the delivery rate of paper is established dependent on the counted number of papers introduced into the intermediate tray. In this case, the larger the counted value or as the paper is positioned on higher layers, the larger delivery rate will be set, so that the delivery rate can be substantially made uniform. Specifically, the papers on the upper layers on which the push-out roller may easily slip is pushed forward a little farther than the papers on the lower layers, and thus all the papers can be well aligned inside the intermediate tray with the result that there will occur no inconvenience due to the shortage in delivery rate. If the process is to be simplified, attempt is made to feed only copying papers on the upper layers, which offer a problem in particular, a little farther than the papers on the other layers As the papers being copied are introduced into the intermediate tray, the number of them is counted until the arrival of the last paper corresponding to the set number of papers is detected. And said last paper is to be fed especially a little farther by the push-out roller, as compared with the other papers.

As a result, the top-positioned paper, which is inclined to be fed only for an insufficient distance, can also reliably reach the copying paper alignment means, whereby there can be avoided any feed error which may take place after the opening of the alignment means.

DETAILED DESCRIPTION OF THE PREFERRED EMBODIMENTS

Figure 1A:
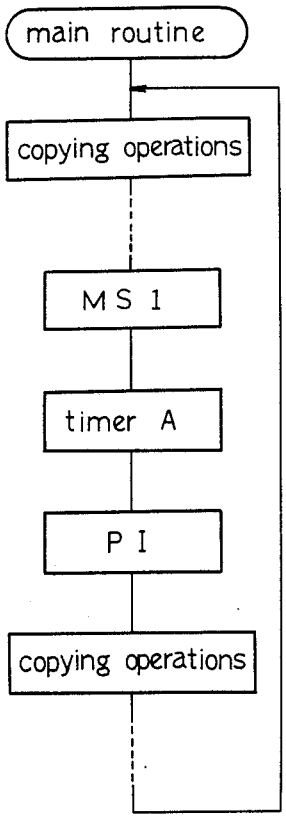
FIG. 1(*a*) through 1(*h*) is a flow chart showing the procedure for process of the copying paper feeding device embodying the present invention.
Figure 1B:
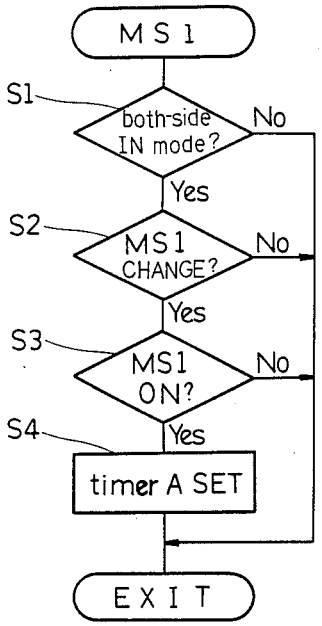
Figure 1C:
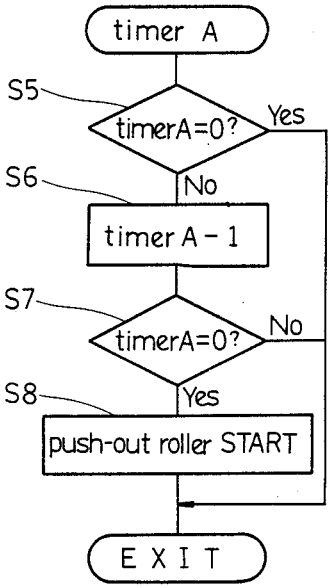
Figure 1D:
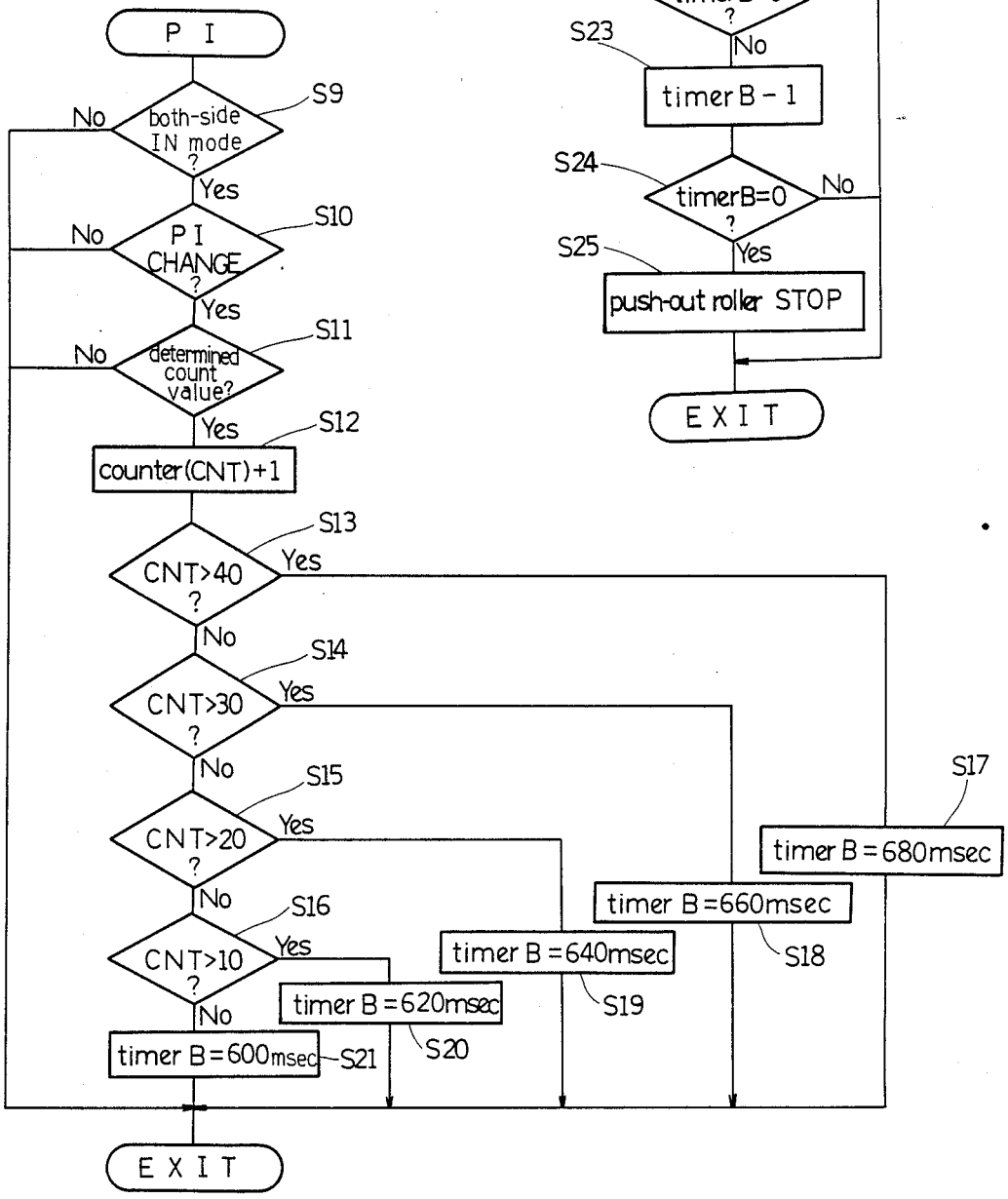
Figure 1E:
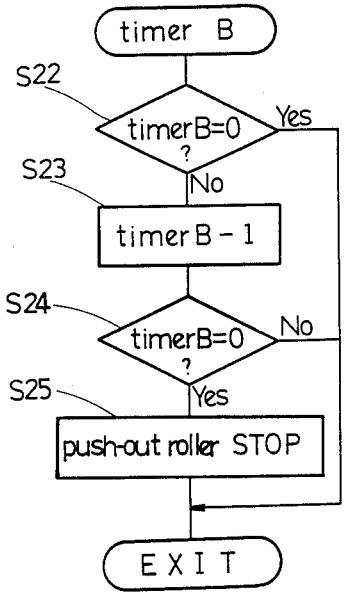
Figure 1F:
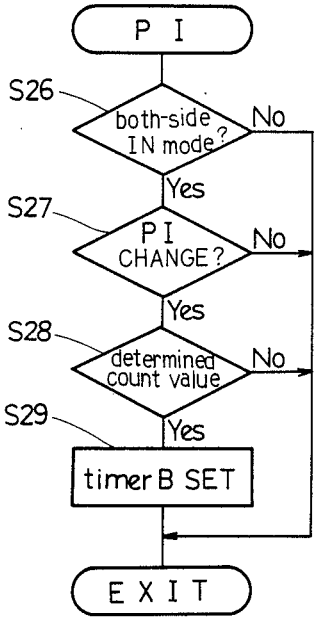
Figure 1G:
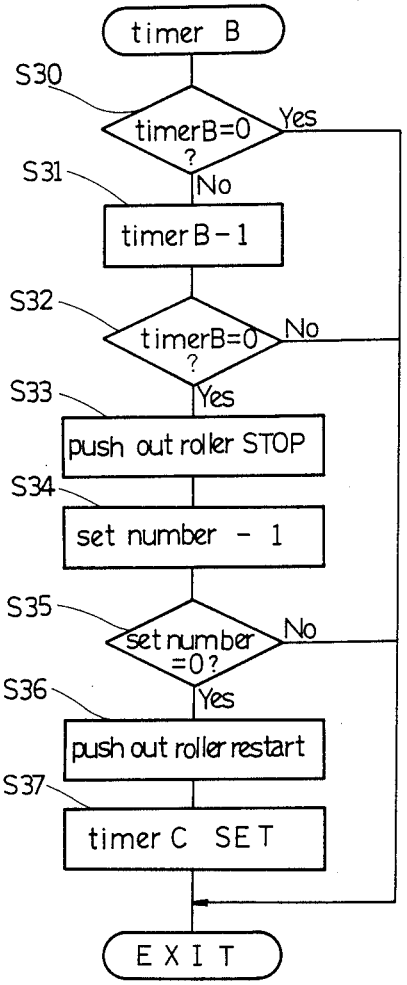
Figure 1H:
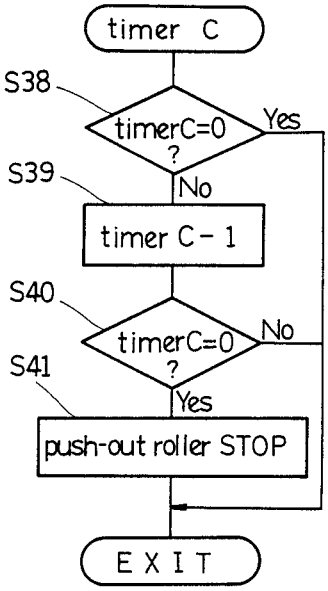
Figure 2:
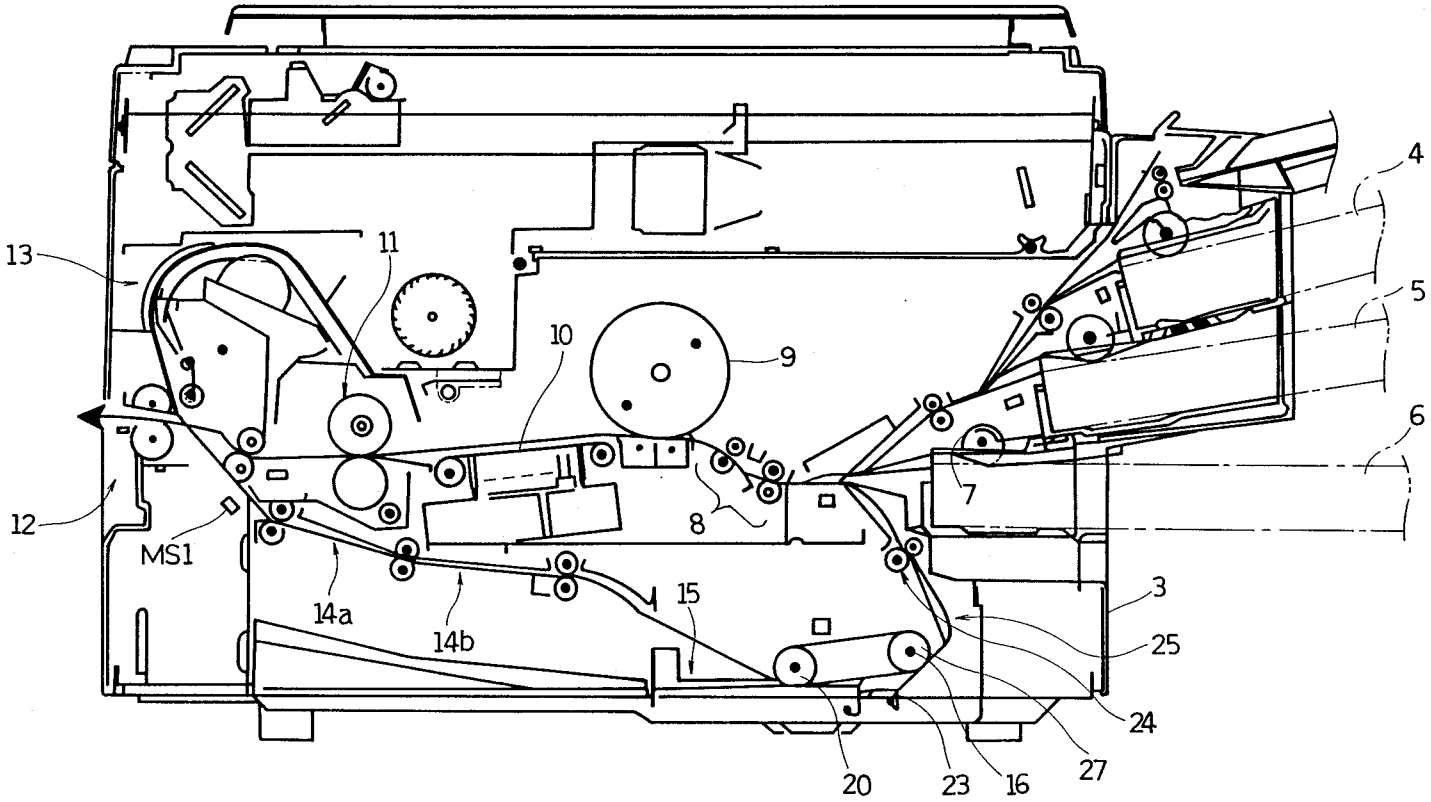
Fig 2 PRIOR ART
FIG. 2 is a schematic cross sectional side view of a copying machine to which said copying paper feeding device can be applied.
Figure 3:
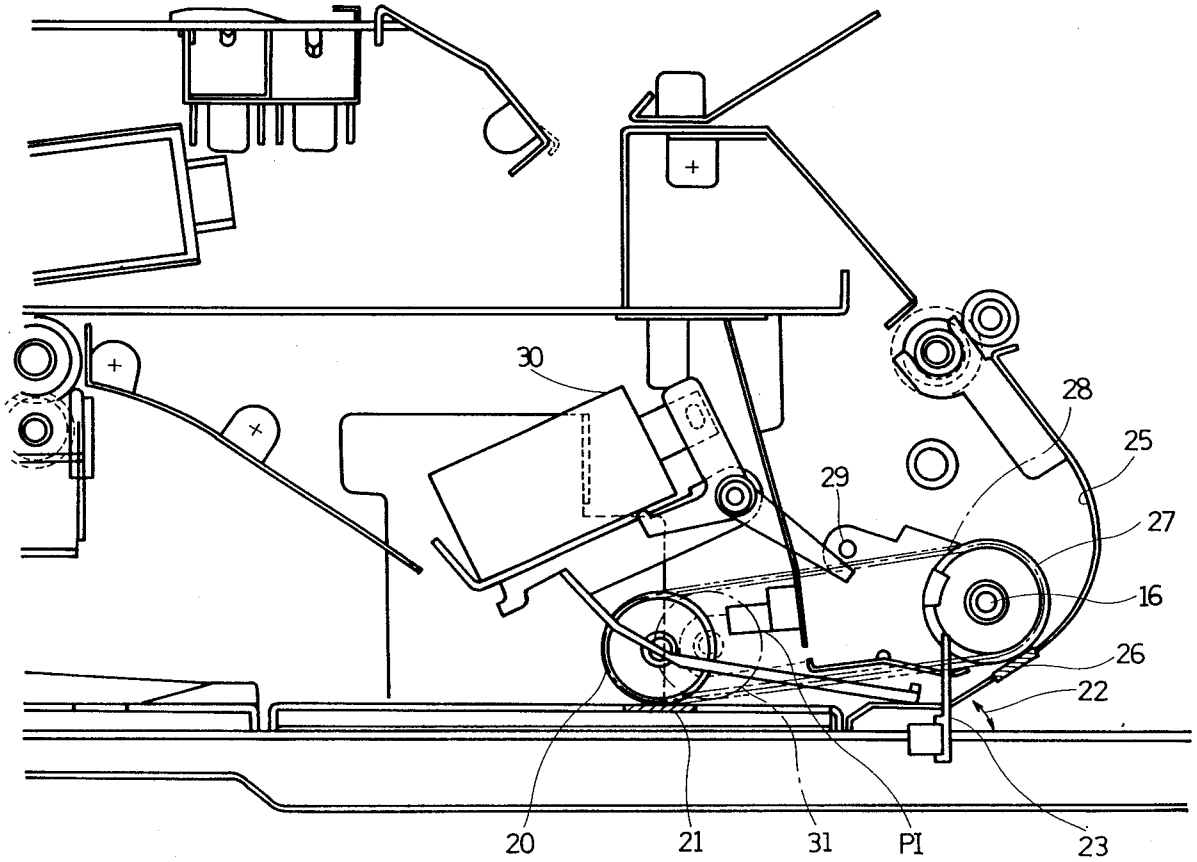
Fig 3 PRIOR ART
FIG. 3 is a view showing in detail a push-out roller of said copying machine.

In order to help understand the present invention, the embodiments of the invention will be described with reference to the flow chart of FIG. 1 and the device shown by FIG. 2.

S1, S2, . . . as shown in the embodiments denote the number of procedure steps.

In this embodiment, the main routine as illustrated by FIG. 1(*a*) involves various processes for copying operations, which are practiced in a predetermined sequence, such as processes for a microswitch MS1, a timer A, and a photointerrupter PI, which processes are carried out in this order, and additionally, these processes are also performed by sequentially repeating the routine wherein the determined copying operations are made.

To begin with, the process for the microswitch MS1 is carried out as shown in FIG. 1(*b*).

This process is adapted, as shown by S1, to determine whether or not a copying paper now in the both-side copying mode is in a position to be fed, or whether the both-side IN mode is now prepared. Such a both-side IN mode may be determined by the position of said stopper 23, namely of whether or not the stopper 23 is in a position before falling down in the both-side copying mode.

If the both-side IN mode has been determined, in S2 a determination will be made of whether or not the microswitch MS1 has been changed in its position, namely of whether or not MS1 has been turned ON from OFF or OFF from ON. The microswitch MS1 is adapted to find out whether or not a copying paper is on the way to the separating trays 14*a* and 14*b* after the paper has been discharged from said switchback member 13. Said microswitch MS1 may be not only a mechanical sensor but also, e.g. of optical or electrostatic capacity type. And this particular microswitch may be either turned ON or OFF when it detects the front end of the paper being copied. This embodiment uses a microswitch which is to be turned ON when the paper passes by.

Accordingly, if it has been found in S3 that the microswitch had been turned ON, it means that the copying paper has passed by a part of the microswitch MS1. As soon as the paper to be copied passes part of the microswitch MS1, the timer A is set in S4.

This timer A serves to set a timing for turning the push-out roller 20 after the paper has passed The timer A incorporates a given count number set to the sizes of passing papers.

As described above, when the timer A is set in S4, the subroutine of timer A as shown in FIG. 1(*c*) starts its processing. That is, S5 attempts to determine whether or not the value of timer A is now equal to zero. Immediately after setting of the timer A, the value can not be zero, and so the answer should be NO, and then the processing is taken over by S6.

A subtraction of 1 from the present count value of timer A is made in S6 and additionally a determination is made in S7 of whether or not the resultant value is equal to zero.

Such processings are practiced in S5–S7 repeatedly in determined cycles of control, during which the copying paper is fed through the separating trays 14*a*, 14*b* to the intermediate tray 15. Thus, after the paper arrives at the intermediate tray 15, but right before the paper is inserted by its leading end into a nip portion between the push out roller 20 and the friction plate 21, S7 determines YES. Then, the push-out roller 20 starts its rotary action to feed the inserted copying paper in a downstream direction (S8).

Just before or after said processing of the timer A, the processing for the photointerrupter PI shown in FIG. 1(*d*) is carried out.

Also in this phase, it is determined whether or not S9 is now in the both-side IN mode.

If the both-side IN mode has been confirmed, then it is determined in S10 if there has been found any change in a signal from the photointerrupter PI.

If a change is noticed in the signal from the photointerrupter PI, it is determined in S11 whether or not the value into which a counter has integrated a signal from the photointerrupter PI has attained to a determined count value. This particular counter, which is not illustrated here, is kept in action during the time from the first ON mode of said microswitch MS1 to the second ON of same. Namely, this counter acts to count the number of a pulse signal from said photointerrupter PI of measuring a distance for which a paper has advanced until a next paper is supplied after the delivery of the old paper. During the time the paper is fed by the push-out roller 20 to reach with its leading and a determined position in front of the stopper 23, the slit plate 31 is rotary accordingly. A measurement is made to find out the amount of advancement of the paper by means of the number of an output pulse produced from the photo-interrupter PI dependent on the rotational number of the slit plate 31.

If it has been determined that the determined count number had been reached in S11, the number 1 is added to a counter CNT for showing the number of copied papers in S12. This counter CNT is in a clear position at the start of a copying operation (when a printing button is pushed). Therefore, as the first, second, . . . papers are subjected to a copying operation one after another, counting takes place to set the number of the papers copied.

In S13, S14, . . . , S16 to follow, it is determined if the value shown by the counter CNT comes in over 40, over 30 but under 40, over 20 but under 30, over 10 but under 20, or under 10.

If CNT>40 (S13), the value of a timer B is set to 680 msec in S17. If 40≧CNT>30 (S14), the value of the timer B is set to 660 msec. If 30≧CNT>20 (S15), the value of the timer B is set to 640 msec. If 20≧CNT>10 (S16), to 620 msec. If CNT≦10 (S16), to 600 msec.

Thus, this embodiment is arranged such that the value of the timer B (corresponding to the delivery rate by roller 20) is designed to be set in stages per 10 pieces of papers so that the delivery rate of papers on the upper layers will become larger.

At the setting of the timer B in this way, the counting procedure steps will be carried out by the timer B as shown in FIG. 1(*e*).

The counting by the timer B is achieved in the same manner as in the timer A as shown in FIG. 1(*c*), namely at first it is determined whether or not the timer B is equal to zero (S22), and if not zero, the subtraction of 1 from the value of the timer B is carried in S23.

And in S24 whether or not the resultant value has reached zero, and at the time point where the timer B has become zero, the push-out roller 20 stops its rotation (S25).

In this manner, the push-out roller 20 keeps rotating during the time from the start of rotary motion in S8 till the end of same (S25). During this period, copying papers on the upper layers of the stack of papers are successively pushed forward a little farther than other papers until the former collide at the leading ends with the stopper 23 in a uniform manner.

In the foregoing embodiment, each time the number of the papers which have been fed into the intermediate tray 15 are increased by 10, the delivery rate is gradually increased to absorb any subsequent slipping motion of the push-out roller 20, and such a delivery rate can be set properly increased. Alternatively, each time the number of papers is increased by one (or more), the delivery rate may be increased by a determined amount or in proportion to a certain function.

As already mentioned, of all the papers discharged into the intermediate tray 15, some, except for the top one, may be pushed forward to some degree at the same time when a paper placed on the top of the former is delivered. But as that is not the case with the paper on the top of the stack of papers, for the paper in question, this push-out action is highly required.

The flow charts of FIGS. 1(*f*)-(*h*), which will be described hereinafter, show the steps for the above arrangement, which follow the steps of FIGS. 1(*b*), (*c*) (and which is replaced by the steps of FIG. 1(*d*)); only the paper on the top is destined to be pushed out a little farther than the other papers. In this case, as the steps corresponding to the steps as shown in the flow chart of FIG. 1(*c*) are the same as in said embodiment, only the subsequent steps will be described.

Before or after the processing by the timer A as shown in FIG. 1(*d*), the processing for the photointerrupter PI shown by FIG. 1(*f*) is carried out.

It is also determined here whether or not the both-side IN mode exists at present (S26). If the both-side IN mode is only confirmed, it will be determined is S27 whether or not there has occurred a change in a signal from the photointerrupter PI.

If a change has taken place with the signal from the photointerrupter PI, it will be determined in S28 whether or not the value of a counter which acts to integrate the signal from the photointerrupter PI has reached a predetermined count value. This specified counter remains operating during the time from the first ON mode of said microswitch MS1 to the second ON of same. That is to say, the number of a pulse signal from said photointerrupter PI which is adapted to measure the advanced rate of a paper being copied is counted during the time from a supply of one paper until a supply of other paper. During the time the leading end of the copy paper pushed out by the push-out roller 20 comes to a predetermined position in front of the stopper 23, the slit plate 31 is rotary accordingly. Then, the delivery of the paper is measured by an output pulse signal from the photointerrupter PI corresponding to the number of rotations that the slit plate 31 had then.

If the determined counter number has been reached (S28), the timer B will be reset in order to further feed the paper in the direction of the stopper 23 (S29).

The following counting by the timer B of FIG. 1(*g*) is effected in the same manner as in the timer A as shown in FIG. 1(*c*). At the outset, it is determined in S30 whether or not the timer B is in a zero position, and if not in zero position, the substruction of 1 from the value of the timer B is practiced (S31).

Then, it is determined whether or not the resultant value has reached zero (S32), and when the timer B has turned to zero, the push-out roller 20 stops its rotary motion (S33).

In this way, the push-out roller 20 continues to rotate during the time from its start of rotation in S8 until the termination of its rotary motion in S33. During this period, the copy papers are successively pushed forward one after another so that the leading end thereof should collide with the stopper 23 theoretically.

When the processing is finished in S33, the subtraction of 1 from the originally set number of papers to be copied or the set number is made, because in fact the feed of the papers into the intermediate tray 15 has been completed (S34). In S35 it is determined whether or not the set number has become zero. If the set number of papers has been found to be zero, it is determined that a paper fed immediately before the set number becoming zero is the very one corresponding to the set number of paper, i.e. the paper to be placed on the top of the stack of papers. Such a paper placed on the top must be pushed out a little farther than other papers. So, in S36, the push-out roller 20 is restarted, and a timer C is set in S37. The timer C is intended to set in advance the time at which the toppositioned paper is pushed out for a determined distance. As illustrated in FIG. 1(h), in the subroutine of counting the timer C, it is determined whether or not the timer C is zero-positioned (S38).

If the timer C is not so positioned, one (1) is subtracted from the value of the timer C in S39, and it is determined again whether or not the timer C has become zero (S40).

When the top-positioned paper is advanced for the determined length, the value of the timer C will be reduced to zero then. When yessed in S40, the push-out roller 20 stops in S41.

The top-positioned paper is pushed forward farther by the determined length than the other papers, and the leading end of said paper never fails to arrive at the stopper 23.

Though in the above-described embodiment, the push-out rate of a paper to be copied is established by the count number of the photointerrupter PI and the count number of the timer B, the signal from the photointerrupter PI may be regarded simply as a command signal for starting supply of a copying paper so as to decide by way of the count number of the timer B only how long the paper should be pushed out.

This invention may be practiced or embodied in still other ways without departing from the spirit or essential character thereof. The preferred embodiments described herein are therefore illustrative and not restrictive, the scope of the invention being indicated by the appended claims and all variations which come within the meaning of the claims are intended to be embraced therein.

What is claimed is:

1. A copying paper feeding device for an intermediate tray of a copying machine, wherein pressed by a push-out roller, copying papers having one side formed with a toner image and stored temporarily within the intermediate tray are fed by the rotation of the push-out roller in the direction of a copying paper alignment means located downstream, characterized in that a means is provided for counting a number of copying papers fed into said intermediate tray and a means is provided for increasing a time of rotation of the push-out roller of the copying papers in response to the count of the number of copying papers fed into said intermediate tray, whereby upper positioned copying papers are pushed forward a little further than lower-positioned copying papers until the upper-positioned copy papers collide with said copy paper alignment means.

2. A device as claimed in claim 1, wherein after a predetermined number of copying papers are fed into said intermediate tray, the upper-positioned copying papers are pushed forward a little further than the lower-positioned copying papers until the upper-positioned copying papers collide with said copying paper alignment means.

3. A copying paper feeding device of an intermediate tray, wherein pressed by a push-out roller, copying papers having one side formed with a toner image and stored temporarily within the intermediate tray are fed by the rotation of the push-out roller in the direction of a copying paper alignment means located downstream, characterized in that a means is provided for counting a number of copying papers fed into said intermediate tray and a means is provided for increasing a time of rotation of the push-out roller in response to the number of the copying papers fed to said intermediate tray, whereby a last paper of said copying papers fed into said intermediate tray will be pushed forward a little further than other copying papers previously fed into said intermediate tray until said last paper of said copying papers collides with said copying paper alignment means.

* * * * *